US008210894B2

(12) United States Patent
Chan

(10) Patent No.: US 8,210,894 B2
(45) Date of Patent: Jul. 3, 2012

(54) TOY WITH SOUND-ACTIVATED MOTION

(75) Inventor: Albert Wai Tai Chan, Taipei (TW)

(73) Assignee: Thinking Technology Inc., Nassau (BS)

( * ) Notice: Subject to any disclaimer, the term of this patent is extended or adjusted under 35 U.S.C. 154(b) by 538 days.

(21) Appl. No.: 12/306,462

(22) PCT Filed: Jun. 26, 2007

(86) PCT No.: PCT/CA2007/001154

§ 371 (c)(1),
(2), (4) Date: Mar. 5, 2009

(87) PCT Pub. No.: WO2008/000080

PCT Pub. Date: Jan. 3, 2008

(65) Prior Publication Data

US 2009/0280717 A1 Nov. 12, 2009

(51) Int. Cl.
*A63H 30/00* (2006.01)

(52) U.S. Cl. ..... 446/175; 446/298; 446/484

(58) Field of Classification Search ..... 446/175, 446/297–300, 330, 390, 356, 484
See application file for complete search history.

(56) References Cited

U.S. PATENT DOCUMENTS

| | | | | |
|---|---|---|---|---|
| 4,165,581 | A * | 8/1979 | Wolf | 446/175 |
| 4,245,430 | A * | 1/1981 | Hoyt | 446/175 |
| 4,795,395 | A * | 1/1989 | Oishi et al. | 446/175 |
| 5,176,560 | A * | 1/1993 | Wetherell et al. | 446/175 |
| 6,565,407 | B1 * | 5/2003 | Woolington et al. | 446/175 |
| 6,652,353 | B1 | 11/2003 | Lund et al. | |
| 6,758,716 | B1 * | 7/2004 | Rehkemper et al. | 446/297 |
| 2006/0135034 | A1 | 6/2006 | Rung et al. | |

* cited by examiner

*Primary Examiner* — Dmitry Suhol
*Assistant Examiner* — Alex F. R. P. Rada, II
(74) *Attorney, Agent, or Firm* — Drinker Biddle & Reath LLP

(57) ABSTRACT

A toy with sound-activated motion is provided. The toy comprises a toy body, a single motor within the body, adapted to turn in opposite directions in response to changes in electrical polarity, and control means to automatically reverse the polarity of an electrical current being supplied to the motor in response to an acoustical or electromagnetic input signal. The control means is adapted to automatically reverse the polarity in response to a changing acoustical or electromagnetic input signal.

20 Claims, 3 Drawing Sheets

TOY WITH SOUND-ACTIVATED MOTION

FIELD OF THE INVENTION

The present invention relates generally to toys. More particularly, the present invention relates to a toy with sound-activated motion.

BACKGROUND OF THE INVENTION

In the field of toys, many are familiar with the flowers or dolls which move in one or more ways (such as dancing, shuffling, or other type of movement). The movement can be controlled in any number of ways, such as through the actuation of a button on the toy, through remote control, or in response to a sound such as a voice or a musical tune. In the latter case, the provision of the sound causes the toy to move about from a stationary position, or to be displaced from that position. Typically, such as is the case with the dancing flowers, the sound is picked up by a microphone, located within the apparatus, and passed through an amplifier to create a voltage. The voltage is then used to create movement which causes the flower to move about. Typically, the louder the sound, the greater the voltage and therefore, the greater the movement.

In these and other toys known in the art, a single motor is used which causes motion in a single direction. The motor typically requires an eccentric axle to generate an off-centre force. For example, U.S. Pat. No. 5,056,249 to Sakurai, describes an artificial flower with an angularly movable shaft. In order for the toy to move in multiple directions, multiple motors are required to move different movable components, such as to have the toy move back and forth from foot to foot (i.e., as would be required in a toy with dancing motion, for example). U.S. Pat. No. 6,652,353 to Lund et al., describes a toy dog which moves across a surface. The toy has two motors: one to move a set of legs on the left side of the toy, and another motor to move a set of legs on the right side. Other dolls having multiple moving parts are described in U.S. Pat. No. 5,628,668 to Takemae, U.S. Pat. No. 6,071,170 to How, and U.S. Pat. No. 5,147,238 to Kelley et al. In the absence of multiple motors, it has been difficult to generate separately moveable parts of the toy. This is evident in U.S. Pat. No. 6,746,301 to Lund. Thus, the two motors have been required to generate an off-centre force to create complex movement.

Toys which have a wider range of motion are known in the art. U.S. Pat. No. 7,115,014 to McGrath discloses a walking toy dog, and U.S. Pat. No. 6,758,716 to Rehkemper et al. discloses a dancing toy figure doll. Both of these toys are preferably controlled using a remote control device and include a tethering means connected thereto. Toys of this sort are typically more difficult to maneuver in tight spaces, and can be especially difficult for younger users and those with limited manual dexterity.

In addition, toys which move in different directions also require separate features or supports to assist the toy in maintaining its balance when each foot is "reset", i.e., returned to a resting position on the surface prior to a subsequent movement by it or another leg or foot. However, this causes the toy to become quite expensive to produce. Furthermore, the balancing features or support may be quite sensitive or delicate which results in the toy being more prone to damage.

Furthermore, in order to shorten the time between movements of the toy, the motors need to be sped up which can lead to a tipping of the toy since fixed intervals between motor switching increases motor speed which promotes tipping.

Sound-activated toys are known in the art. U.S. Pat. No. 6,652,353 to Lund et al., discloses a sound activated toy comprising sets of legs which rotate in response to a sound stimulus. This toy requires a pair of motors to cause each set of legs to rotate in opposite directions.

U.S. Pat. No. 6,149,491 to Arad discloses a doll having a mechanism which allows displacement of legs frontwardly and a motor connected to a mechanism to drive and displace the legs, arms and head with respect to the body.

U.S. Pat. No. 4,795,395 to Oishi et al. discloses a sound-activated animal motion toy having a motor and multiple movable parts. The toy, however, has limited mobility and requires pushing an operating lever to change the rotation of the motor to enable the toy to move in a reverse direction.

It is, therefore, desirable to provide a toy with sound-activated motion which only requires a single motor for off-centre movement and automatically moves in alternate directions.

SUMMARY OF THE INVENTION

It is an object of the present invention to obviate or mitigate at least one disadvantage of previous toys with sound-activated motion.

In a first aspect, the present invention provides a toy with sound-activated motion, comprising: a toy body; a motor within the body, adapted to turn in opposite directions in response to changes in electrical polarity; and a control means to automatically reverse the polarity of an electrical current being supplied to the motor in response to an acoustical or electromagnetic input signal.

Typically, a single motor is used in one or more embodiments of the present invention. The motor is automatically adapted to turn in opposite directions, thereby permitting the toy to move in more than one direction. Advantageously, the toy can move in different directions without the need of a mechanical (i.e., manual) or remote control electrical intervention. A further advantage of the current invention is that there is a significant decrease in overall costs since there is only a single motor located within the toy, combined with the ability to provide movement in multiple directions.

The control means is typically an integrated circuit chip which provides a digital signal which allows for the synchronization of the movement of the toy with an acoustical or electromagnetic input signal. Thus, the toy is able to move in one or more directions in response to sound, such as human-derived sounds, music, or other acoustical input signals. Advantageously, no amplifier is required. The synchronization of the input signal and the motion of the toy provides a toy which is more realistic in appearance while in motion.

In accordance with one embodiment of the present invention, the control means is an integrated circuit (IC) chip and/or a transistor. The chip is ideally programmed to provide synchronization between an input signal and the motor and, ultimately, the movement of the toy. The control means provides a digital signal which is determined in response to the input signal. Typically, the integrated circuit chip is programmed to generate an on or off signal at a defined level of the input signal.

The control means is adapted such that the signal sent from the control means to the motor can be dampened in response to the movement of the toy. In one such embodiment, an interval of current of a first polarity, prior to switching to the reverse polarity, is chosen to promote damping of movement of the toy.

In particular, the control means is especially suited to be used with a reversible motor, to automatically cause a reverse in the polarity of the motor while the toy is in motion. This feature eliminates the need for an additional external input stimulus (such as a mechanical or remote control electronic means) to cause the toy to move in different directions.

In an exemplary embodiment, the toy is a dancing toy which dances in response to the changing acoustical or electromagnetic signal, such as human voice, music or any other audible input. The input signal can also be a preprogrammed set of movements which do not require any sound input from an external source. The dampening of the signal from the control means to the motor prevents the motor from causing the toy to tip over while in motion. This is particularly advantageous for prolonged entertainment for the user, as the toy will continue to move as long as there is an input signal. Further, preventing tipping of the toy can reduce the risk of damage to the toy from repeated tipping or falling off a table or the like, thus reducing any potential hazards to especially younger users, such as young children.

In one particular embodiment, the toy comprises one or more moveable parts attached thereto which move in response to the acoustical or electromagnetic input signal. The parts can be synchronized together in concert with the single motor. For example, in a toy animal having a plurality of limbs (e.g., arms, legs, head, lips/beak, etc.), the limbs can all move in synchronicity. Further, the control means can be programmed to provide eccentric movement of the limbs, rather than a fixed, monotonous movement. To the user, an exemplary toy having any or all of these features is perceived as being more "life-like" when in motion.

In a further particular embodiment, the toy is a dancing toy with two moveable parts thereto for resting the toy on a surface. Typically, two moveable parts are feet shaped to increasingly resist tipping away from a resting position in response to a force generated by the motor.

In a further alternative embodiment, an electronic input means such as a CD music player, MP3 player or the like, may be connected to the toy to provide a digital signal directly to the toy, therefore removing the need to convert the input sound signal to a digital signal. Also, the toy may serve as a speaker to amplify the music from the MP3 player while the toy is moving and dancing. Power may also be drawn from the MP3 player to operate the toy so that other power sources, such as the set of batteries, are not required. Thus, an external speaker may be provided to acoustically reproduce the digital input signal.

The toy may also comprise a preprogrammed set of sounds, such as prerecorded speech or music, which can be played through the actuation of one or more buttons on the toy.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a toy with sound-activated motion. More particularly, the present invention provides a toy with sound-activated motion, comprising: a toy body; a single motor within the body, adapted to turn in opposite directions in response to changes in electrical polarity; and control means to automatically reverse the polarity of an electrical current being supplied to the motor in response to an acoustical or electromagnetic input signal.

A toy in accordance with the present invention can be any mechanical toy known in the art which has been adapted to move in one or more different positions or directions. These toys can take the shape of traditional mechanical toys known in the art having a variety of moving parts. Suitable toys known in the art can include, but are not limited to, human or humanoid dolls, non-human animals, plants, flowers, or other similar toys representing animate or inanimate objects. More ideally, a suitable toy is one which represents an animal having one or more moveable parts thereon, such as a head, limbs (e.g., arms, legs, wings and/or a tail, for example) or other appendages.

Figure 1:
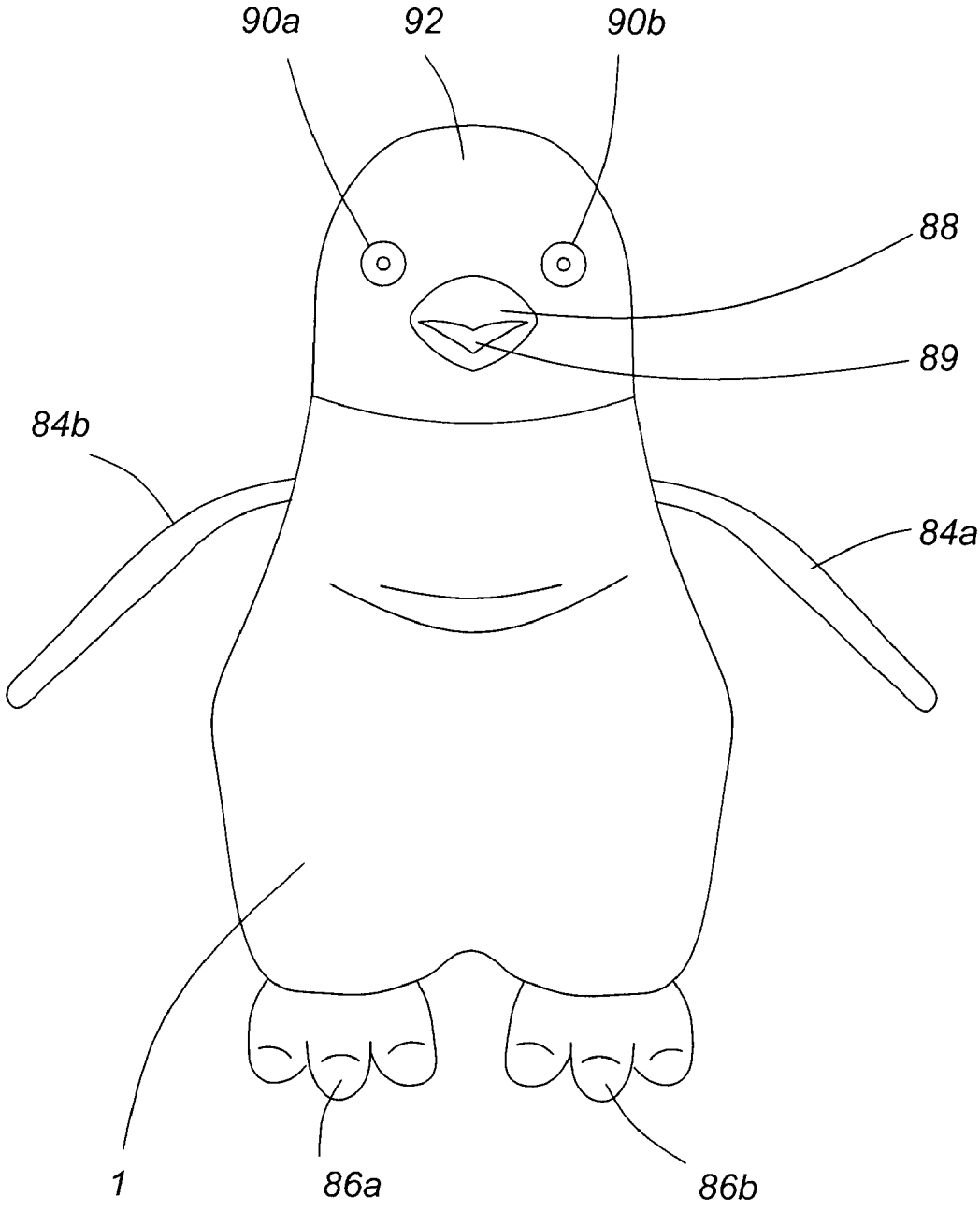
FIG. 1 shows an exemplary toy in a resting position in accordance with one embodiment of the present invention.

FIG. 1 shows one example of a toy in accordance with the present invention. The example shown is a toy shaped as a penguin; however, it should be noted that any suitable toy known in the art could be used. The toy penguin comprises a main body portion 1. The body portion 1 comprises a head portion 92 having eyes 90*a* and 90*b*, as well as beak portions 88 and 89. Wings 84*a* and 84*b*, and feet 86*a* and 86*b*, extend from the main body portion 1. The toy illustrated in FIG. 1 is shown in a resting position, which can be on a generally flat surface.

The toy in accordance with the present invention can be of any suitable, durable material. It is conceived that the toy could be covered or decorated with materials such as fur, paint, decals, or other appropriate decorative materials to enhance the visual appearance of the toy. The exemplary penguin toy shown in FIG. 1 can be covered with such materials. Ideally, the materials should be appropriate for handling by a younger-aged user to prevent injury. Also, materials are typically selected to offer adequate protection for protecting the main body portion and any electrical and/or mechanical components therein, from damage.

In one embodiment, the toy may include large feet to assist in the balancing of the toy when in the standing position. The shape and size of the feet may also be shaped to create an increasing resistance to tilting. Thus, the feet function as cams to increasingly resist further motion in response to a constant force to prevent the toy from tipping over.

Figure 2:
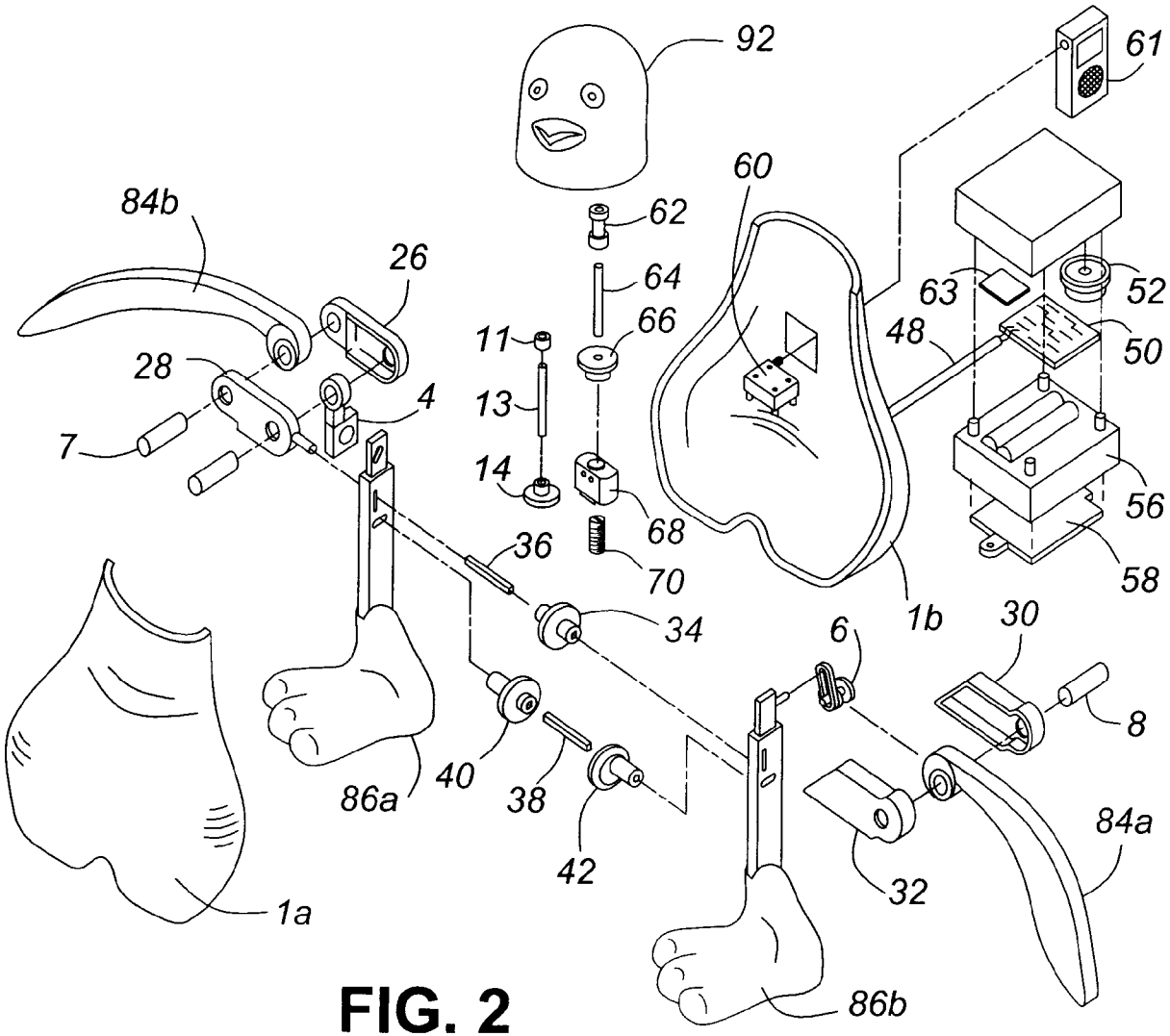
FIG. 2 is an exploded view of an embodiment of a toy in accordance with the present invention.

Turning to FIG. 2, an exploded view of a toy in accordance with one embodiment of the invention is shown. In the example shown, the toy 10 comprises a head portion 12, a front body portion 14, a rear body portion 16, a right hand portion 18, a left hand portion 20, a right leg portion 22 and a left leg portion 24.

The right hand portion 18 is connected to a right upper arm portion 26 and a right lower arm portion 28 via arm holder 4 while the left hand portion 20 is connected to a left upper arm portion 30 and a left lower arm portion 32 via left arm motion cam 6. Axles 7 and 8 can be provided in the hand portions. Certainly, any suitable hand or hand-like portions, which may or may not be comprised of multiple components, can be used in connection with the motion cam and, eventually, the motor.

In the embodiment shown, the arm portions are different. If desired, the arms can perform different functions depending on the shape and appearance of toy. For example, one hand can be waving, using a tool, or performing a simulated task, while the other hand remains stationary. However, it would be understood that any combination of similar or different arm portions or other appendages may be contemplated.

The right leg portion 22 and the left leg portion 24 are connected via a compound gear 34 and an axle 36 and also by a square axle 38 between a right leg motion cam 40 and a left leg motion cam 42. The square axle 38 fits within corresponding slots 44 in the one end of the motion cams 40 and 42. The second end of the each of the motion cams 40 and 42 mate with a corresponding slot 46 in the right and left leg portions 22 and 24. The connection between the hand portions and leg portions with the motor can be any conceivable distance to allow movement of the various portions. For a toy intended to resemble an animal, for example, the various limbs can be positioned and attached to the motor in more anatomically-correct locations on the main body portion 1 as shown in FIG. 1.

The rear body portion 16 is connected via an electrical wire 48 to a printed circuit board (PCB) 50 containing a plurality of integrated circuit chips 51 which serve as a control means for controlling operation and movement of the toy 10. An external speaker 52 is located with the PCB 50 within a box having a cover 54 and a box bottom 56. The box bottom 56 includes a location whereby batteries may be inserted and then covered by a battery box cover 58. An audio jack 60 is also located within the rear body portion 16; however, an audio jack can be placed at any other suitable location on the toy. The audio jack 60 typically receives a connector, such as from a musical player, including an MP3 player, portable CD player 61 or the like. A microphone 63 is also located within the doll 10. The microphone 63 receives external audio input not typically transmitted through the audio jack. The external audio can include any external sound such as, but not limited to, human voice or music emanating from a musical player speaker, for example. Although shown as being powered by a set of batteries, other means for powering the toy 10 are contemplated.

The head portion 12 is connected via a neck plug 62 to an axle 64 which is further housed within a pinion gear 66. The pinion gear 66 rests atop a motor 68 which has a worm gear 70 attached at a bottom end. The worm gear 70 is in contact with the compound gear 34. A connection with axle 13, crown gear 14 and pinion gear 11 may also be used.

Prior to use, power is required to be provided for operation of the toy 10. In the current embodiment, a battery is inserted into the battery slot, defined by the box bottom 56 and battery cover 58, although other means of providing power, such as via an adapter for example, are contemplated.

In operation, when the toy is powered up, or turned on, the toy 10 remains in a stationary, or resting, position (such as shown in FIG. 1) with both legs balanced and supported on the top of a surface. Current from the battery is transmitted and flows through the components in the toy to power up the components such as the audio jack 60, the PCB 50 and the motor 68.

Once the audio jack 60 receives an input signal from a musical player, or the microphone senses an external sound, such as music or a voice, the integrated printed circuit board, or PCB, 50 receives the sound signal and processes the analog signal to generate a digital signal representative of the sound signal. For instance, if the sound signal has between 80 to 90% noise, a digital signal of 1 is created, otherwise, a digital signal of 0 is created.

After the digital signal is created, the PCB 50 determines whether or not to reverse the direction of the motor 68 (based on the digital signal) in order to change the direction of movement of the toy 10. If a signal of 1 is created, the PCB 50 transmits a control signal to the motor, instructing the motor to reverse its direction thereby to create a resistance force which causes the toy to move in a new direction. If the toy is in a stationary position (such as its initial position), the generation of a signal of 1 causes the toy to move in a predetermined direction. For example, toy may respond by lifting up one of its legs. Otherwise, if the toy is already in motion, for example, the toy 10 may be already lifting up its right leg 22 via the right leg motion cam 40, the generation of the 1 signal causes the direction of the motor to be reversed with the resultant resistance force capable of causing the right leg to return to the surface and the left leg to lift up.

Typically, the motor is timed to run for an amount of time to generate a force to tip the toy without causing the toy to roll over. If the sound stimulus stops, the toy simply rocks back to a resting position.

The direction of the single motor is controlled by reversing the polarity of the current or voltage being supplied to the motor causing the motor to operate and rotate in opposite directions. The PCB 50 may be used to shorten motor intervals nearly infinitely without increasing the motor speed.

The ability to control interval durations allows for precise motion control and therefore reduces or eliminates the risk of tipping inherent in prior art sound-activated toys when motor speed is increased. The constant reversing of the motor also allows for a motion to be imparted to the toy as the motor is continuously reversing causing the legs (and/or other limbs or appendages, for example) to be similarly moved. In fact, if the polarity is reversed while the toy is still moving in response to the current of the first polarity, motion of the toy will be damped. This prevents overly abrupt changes in toy direction and may assist in preventing the toy from tipping over despite a vigorous initial movement.

Thus, the automatic reversibility of the single motor in the toy of the present invention is particularly advantageous to the user for providing a range of movements. The toy of the present invention can move merely by sound activation. However, it would be conceivable that in other embodiments of the toy, the polarity of the motor could be controlled by manual switches. Furthermore, the voltage may be controlled to generate different motor speeds to accelerate or decelerate the movement of the legs, or other appendages of the toy.

Ideally, if one or more movable appendages (such as limbs, lips, eyes, or head, for example) are included in the sound-activated toy of the present invention, the sound activation can cause any or all of the appendages to move together in synchronicity with each other. In other words, the appendages can be linked to the single, reversible motor in accordance with the exemplary arrangement shown in FIG. 2. Thus, sound activation of the speaker can cause any or all of the movable appendages to move in response to an input signal. Further, the control means can be programmed in any number of ways as desired, such that the movement of the appendages is synchronized with a particular input signal. For example, if the sound input signal comprises a change in the rhythm pattern (e.g., change in the style, beat or tempo of the music, etc.), the control means can be programmed such that the response by the motor and movable elements attached thereto is also changed in synch. Such an arrangement can provide a more realistic response by the toy to the input signal.

Figure 3:
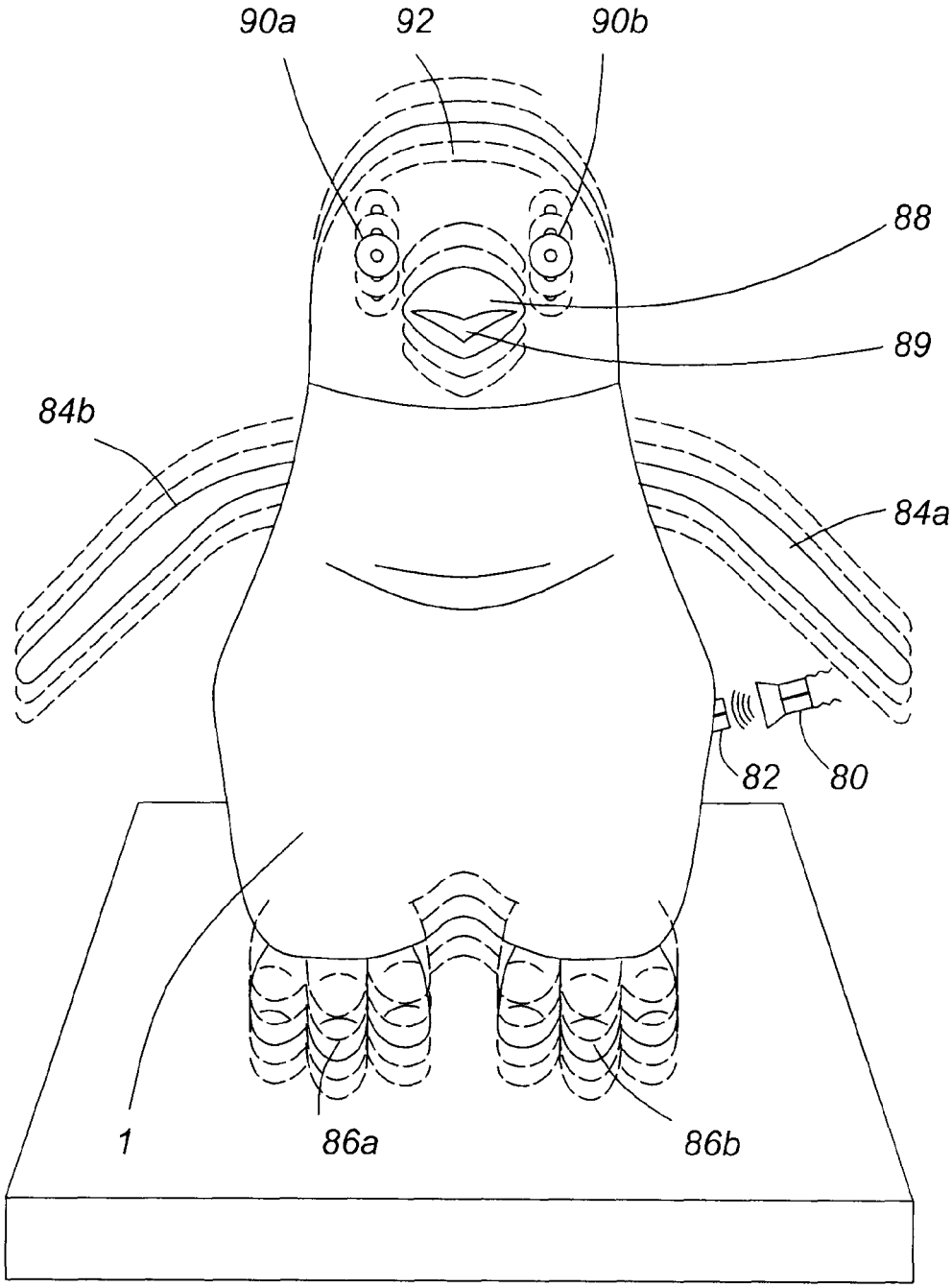
FIG. 3 shows the exemplary toy of FIG. 1, moving in response to an external acoustic signal.

FIG. 3 illustrates the toy of FIG. 1, moving in response to an input signal. An acoustic signal from speaker 80 is sent to microphone 82 on the main body portion 1 of the toy. When the toy is in operation, the acoustic (sound) input signal activates a control means connected thereto and typically on the inside of main body portion 1. The control means activates a motor which in turn actuates one or more axles connected thereto for moving the various limbs of the toy.

In the example shown, when microphone 82 detects a sufficient quantity of sound, movement is caused in wings 84*a* and 84*b*, head portion 92, beak portions 88 and 89, eyes

90*a* and 90*b*, and feet 86*a* and 86*b*. For example, typical movement can include flapping of wings, bobbing of the head from side to side, eye movement from side to side, an up and down motion of the beak portions, and an up and down motion of the feet. In one particular embodiment of the present invention, the toy appears to be dancing in response to music. It will be appreciated that any number of additional or fewer moveable parts can be incorporated into the toy. Further, the toy may be programmed to move any or all of its moveable parts, or produce a pre-recorded sound, simply by turning on the toy. Switching from a pre-programmed set of movements or sounds may involve switching or pushing a button on the toy to activate a different mode.

In another possible embodiment, the effect of gravity and presence of a pivot point for the toy allows motion to be created and not controlled by the motor such that the arms may wave or the head may move depending on the angle and speed of motion of the toy.

In a further alternative embodiment, a electronic input means such as a CD music player, MP3 player or the like, may be connected to the toy to provide a digital signal directly to the toy, therefore removing the need to convert the input sound signal to a digital signal. Also, the toy may serve as a speaker to amplify the music from the MP3 player while the toy is moving and dancing. Power may also be drawn from the MP3 player to operate the toy so that other power sources, such as the set of batteries, are not required.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A toy with sound-activated motion, comprising:

a toy body;

a single motor within the body, adapted to turn in opposite directions in response to changes in electrical polarity; and control means to automatically reverse the polarity of an electrical current being supplied to the motor in response to an acoustical or electromagnetic input signal, wherein an interval of current of a first polarity, prior to switching to the reverse polarity, is chosen to promote damping of movement of the toy.

2. The toy of claim 1 wherein the control means comprises an integrated circuit chip.

3. The toy of claim 2 wherein the integrated circuit chip is programmed to generate an on or off signal at a defined level of the input signal.

4. The toy of claim 3, wherein the toy comprises one or more moveable parts attached thereto which move in response to the acoustical or electromagnetic input signal.

5. The toy of claim 2, wherein the toy comprises one or more moveable parts attached thereto which move in response to the acoustical or electromagnetic input signal.

6. The toy of claim 1, wherein the toy comprises one or more moveable parts attached thereto which move in response to the acoustical or electromagnetic input signal.

7. The toy of claim 1, wherein the toy comprises two moveable parts attached thereto for resting the toy on a surface.

8. The toy of claim 7, wherein the two moveable parts are feet shaped to increasingly resist tipping away from a resting position in response to a force generated by the motor.

9. The toy of claim 1 wherein the input signal is a digital signal.

10. The toy of claim 9, wherein the toy further comprises an external speaker to acoustically reproduce the digital input signal.

11. The toy of claim 1, wherein the input signal is derived from an electrical input means.

12. The toy of claim 11, wherein the electrical input means is an electrical music player.

13. A toy with sound-activated motion comprising:

a toy body;

a single motor within the body, adapted to turn in opposite directions in response to changes in electrical polarity;

control means to automatically reverse the polarity of an electrical current being supplied to the motor in response to an acoustical or electromagnetic input signal, wherein an interval of current of a first polarity, prior to switching to the reverse polarity, is chosen to promote damping of movement of the toy;

one or more moveable parts attached to the toy body, wherein said moveable parts are moved by the motor in response to the acoustical or electromagnetic input signal;

an input device attached to the toy for receiving the acoustical or electromagnetic input signal and activating the control means; and an output device for broadcasting sound from the toy.

14. The toy of claim 13, wherein the input device is a microphone or an electronic input means.

15. The toy of claim 14, wherein the electronic input means is a compact disc or MP3 music player.

16. The toy of claim 15, wherein the output device is a speaker.

17. The toy of claim 15, wherein the sound broadcast from the toy is derived from the control means or from the acoustical or electromagnetic input signal.

18. The toy of claim 13, wherein the output device is a speaker.

19. The toy of claim 18, wherein the sound broadcast from the toy is derived from the control means or from the acoustical or electromagnetic input signal.

20. The toy of claim 13, wherein the sound broadcast from the toy is derived from the control means or from the acoustical or electromagnetic input signal.

* * * * *